US009905343B2

(12) United States Patent
Shingaki et al.

(10) Patent No.: US 9,905,343 B2
(45) Date of Patent: Feb. 27, 2018

(54) PRODUCTION METHOD FOR GRAIN-ORIENTED ELECTRICAL STEEL SHEET AND PRIMARY RECRYSTALLIZED STEEL SHEET FOR PRODUCTION OF GRAIN-ORIENTED ELECTRICAL STEEL SHEET

(71) Applicant: JFE STEEL CORPORATION, Tokyo (JP)

(72) Inventors: Yukihiro Shingaki, Kurahiki (JP); Yasuyuki Hayakawa, Asakuchi (JP); Hiroi Yamaguchi, Kurashiki (JP); Hiroshi Matsuda, Chiba (JP); Yuiko Wakisaka, Kurashiki (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 14/650,073

(22) PCT Filed: Dec. 25, 2013

(86) PCT No.: PCT/JP2013/085317

§ 371 (c)(1),
(2) Date: Jun. 5, 2015

(87) PCT Pub. No.: WO2014/104391

PCT Pub. Date: Jul. 3, 2014

(65) Prior Publication Data

US 2015/0318092 A1 Nov. 5, 2015

(30) Foreign Application Priority Data

Dec. 28, 2012 (JP) ..... 2012-288881

(51) Int. Cl.
*H01F 1/147* (2006.01)
*C21D 8/12* (2006.01)
(Continued)

(52) U.S. Cl.
CPC ..... *H01F 1/14775* (2013.01); *C21D 8/1222* (2013.01); *C21D 8/1233* (2013.01);
(Continued)

(58) Field of Classification Search
CPC .. C21D 8/1261; C21D 8/1272; C21D 8/1294; C21D 8/1283; C21D 8/1222;
(Continued)

(56) References Cited

U.S. PATENT DOCUMENTS 1,965,559 A 7/1934 Goss
4,979,997 A 12/1990 Kobayashi et al.
(Continued)

FOREIGN PATENT DOCUMENTS

CN 1256321 A 6/2000
CN 101311287 A 11/2008
(Continued)

OTHER PUBLICATIONS

Meka et al., "Unusual Precipitation of Amorphous Silicon Nitride Upon Nitriding Fe-2at.%Si Alloy," Philosophical Magazine, Apr. 2012, vol. 92, No. 11, pp. 1435-1455.
(Continued)

*Primary Examiner* — Jessee Roe
(74) *Attorney, Agent, or Firm* — Oliff PLC

(57) ABSTRACT

A method for producing a grain-oriented electrical steel sheets includes subjecting a steel slab to hot rolling to obtain a hot rolled sheet, the steel slab having a specific composition; then subjecting the hot rolled sheet to annealing and rolling to obtain a cold rolled sheet; then subjecting the cold rolled sheet to nitriding treatment with a nitrogen increase of 50 to 1000 ppm, during or after primary recrystallization annealing; then applying an annealing separator on the cold rolled sheet; and setting the staying time in a temperature range of 300 to 800° C. in the secondary recrystallization annealing to 5 to 150 hours.

2 Claims, 2 Drawing Sheets

ΔN=100ppm

ΔN=500ppm

(51) Int. Cl.

| | |
|---|---|
| ***C22C 38/00*** | (2006.01) |
| ***C22C 38/06*** | (2006.01) |
| ***C22C 38/04*** | (2006.01) |
| ***H01F 41/02*** | (2006.01) |
| ***C23C 8/26*** | (2006.01) |
| ***C23C 8/50*** | (2006.01) |
| ***C22C 38/60*** | (2006.01) |
| ***H01F 1/16*** | (2006.01) |
| ***C22C 38/02*** | (2006.01) |
| ***C23C 8/02*** | (2006.01) |
| ***C23C 8/80*** | (2006.01) |
| *C21D 6/00* | (2006.01) |

(52) U.S. Cl.
CPC ..... *C21D 8/1255* (2013.01); *C21D 8/1261* (2013.01); *C21D 8/1272* (2013.01); *C21D 8/1283* (2013.01); *C21D 8/1294* (2013.01); *C22C 38/002* (2013.01); *C22C 38/02* (2013.01); *C22C 38/04* (2013.01); *C22C 38/06* (2013.01); *C22C 38/60* (2013.01); *C23C 8/02* (2013.01); *C23C 8/26* (2013.01); *C23C 8/50* (2013.01); *C23C 8/80* (2013.01); *H01F 1/16* (2013.01); *H01F 41/02* (2013.01); *C21D 6/008* (2013.01); *C21D 2211/004* (2013.01)

(58) Field of Classification Search
CPC ..... C21D 8/81272; C21D 8/1233; H01F 1/14775; H01F 41/02
See application file for complete search history.

(56) References Cited

U.S. PATENT DOCUMENTS

| | | | | |
|---|---|---|---|---|
| 5,643,370 | A * | 7/1997 | Huppi | C21D 8/1255 148/111 |
| 2001/0030001 | A1 | 10/2001 | Hayakawa et al. | |
| 2002/0011278 | A1 | 1/2002 | Komatsubara et al. | |
| 2002/0033206 | A1* | 3/2002 | Cicale' | C21D 8/1255 148/111 |
| 2006/0076086 | A1 | 4/2006 | Terashima et al. | |
| 2014/0202599 | A1* | 7/2014 | Watanabe | C21D 8/12 148/579 |

FOREIGN PATENT DOCUMENTS

| | | | |
|---|---|---|---|
| EP | 0 566 986 | A1 | 10/1993 |
| EP | 1 577 405 | A1 | 9/2005 |
| JP | S40-15644 | B | 7/1965 |
| JP | S51-013469 | B | 4/1976 |
| JP | 2782086 | B2 | 7/1998 |
| JP | H11-335736 | A | 12/1999 |
| JP | H11-335738 | A | 12/1999 |
| JP | 2000-129356 | A | 5/2000 |
| JP | 2001-107147 | A | 4/2001 |
| JP | 2006-316314 | A | 11/2006 |
| JP | 2007-314823 | A | 12/2007 |
| WO | 2014/104394 | A1 | 7/2014 |

OTHER PUBLICATIONS

Apr. 8, 2014 International Search Report issued in International Application No. PCT/JP2013/085317.

Sep. 1, 2015 Office Action issued in Japanese Patent Application No. 2014-554631.

Horky et al., "Effective Grain Growth Inhibition in Silicon Steel," Journal of Magnetism and Magnetic Materials, 1984, vol. 41, pp. 14-16.

Liao et al., "Effect of Nitriding Time on Secondary Recrystallization Behaviors and Magnetic Properties of Grain-Oriented Electrical Steel," Journal of Magnetism and Magnetic Materials, 2010, vol. 322, pp. 434-442.

Dec. 15, 2015 Office Action issued in Japanese Patent Application No. 2014-554631.

Dec. 23, 2015 Extended Search Report issued in European Patent Application No. 13867249.8.

Feb. 1, 2016 Office Action issued in Chinese Patent Application No. 201380068322.3.

Sep. 5, 2016 Office Action issued in Chinese Patent Application No. 201380068322.3.

Oct. 25, 2016 Office Action issued in U.S. Appl. No. 14/650,378.

May 11, 2016 Office Action issued in Korean Patent Application No. 10-2015-7019376.

* cited by examiner

ΔN=100ppm

ΔN=500ppm

PRODUCTION METHOD FOR GRAIN-ORIENTED ELECTRICAL STEEL SHEET AND PRIMARY RECRYSTALLIZED STEEL SHEET FOR PRODUCTION OF GRAIN-ORIENTED ELECTRICAL STEEL SHEET

TECHNICAL FIELD

The present invention relates to a production method for a grain-oriented electrical steel sheet with excellent magnetic properties which enables obtaining a grain-oriented electrical steel sheet with excellent magnetic properties at low cost, and a primary recrystallized steel sheet for a grain-oriented electrical steel sheet which is suitable for production of such grain-oriented electrical steel sheet.

BACKGROUND

A grain oriented electrical steel sheet is a soft magnetic material used as an iron core material of transformers, generators, and the like, and has a crystal orientation in which the <001> direction, which is an easy magnetization axis of iron, is highly accorded with the rolling direction of the steel sheet. Such microstructure is formed through secondary recrystallization where coarse crystal grains with (110)[001] orientation or the so-called Goss orientation grows preferentially, during secondary recrystallization annealing in the production process of the grain-oriented electrical steel sheet.

Conventionally, such grain-oriented electrical steel sheets have been manufactured by heating a slab containing around 4.5 mass % or less of Si and inhibitor components such as MnS, MnSe and AlN to 1300° C. or higher for dissolving the inhibitor components once, and then subjecting the slab to hot rolling to obtain a hot rolled steel sheet, and then subjecting the steel sheet to hot band annealing as necessary, and subsequent cold rolling once, or twice or more with intermediate annealing performed therebetween until reaching final sheet thickness, and then subjecting the steel sheet to primary recrystallization annealing in wet hydrogen atmosphere for primary recrystallization and decarburization, and then applying an annealing separator mainly composed of magnesia (MgO) thereon and performing final annealing at 1200° C. for around 5 hours for secondary recrystallization and purification of inhibitor components (e.g. see U.S. Pat. No. 1,965,559A (PTL 1), JPS4015644B (PTL 2) and JPS5113469B (PTL 3)).

As mentioned above, in the conventional production processes of grain-oriented electrical steel sheets, precipitates such as MnS, MnSe and AlN precipitates (inhibitor components) are contained in a slab, which is then heated at a high temperature exceeding 1300° C. to dissolve these inhibitor components once, and in the following process, the inhibitor components are finely precipitated to cause secondary recrystallization. As described above, in the conventional production processes of grain-oriented electrical steel sheets, since slab heating at a high temperature exceeding 1300° C. was required, significantly high manufacturing costs were inevitable and therefore recent demands of reduction in manufacturing costs could not be met.

In order to solve the above problem, for example, JP2782086B (PTL 4) proposes a method including preparing a slab containing 0.010% to 0.060% of acid-soluble Al (sol.Al), heating the slab at a low temperature, and performing nitridation in a proper nitriding atmosphere during the decarburization annealing process to use a precipitated (Al, Si)N as an inhibitor during secondary recrystallization. (Al,Si)N finely disperses in steel and serves as an effective inhibitor. However, since inhibitor strength is determined by the content of Al, there were cases where a sufficient pinning effect could not be obtained when the hitting amount of Al during steelmaking was insufficient. Many methods similar to the above where nitriding treatment is performed during intermediate process steps and (Al,Si)N or AlN is used as an inhibitor have been proposed and, recently, production methods where the slab heating temperature exceeds 1300° C. have also been disclosed.

On the other hand, investigation has also been made on techniques for causing secondary recrystallization without containing inhibitor components in the slab from the start. For example, as disclosed in JP2000129356A (PTL 5), a technique enabling secondary recrystallization without containing inhibitor components, a so-called inhibitor-less method was developed. This inhibitor-less method is a technique to use a highly purified steel and to cause secondary recrystallization by means of texture control.

In this inhibitor-less method, high-temperature slab heating is unnecessary, and it is possible to produce grain-oriented electrical steel sheets at low cost. However, this method is characterized in that, due to the absence of an inhibitor, magnetic properties of the products were likely to vary with temperature variation in intermediate process steps during manufacture. Texture control is an important factor in this technique and, accordingly, many techniques for texture control, such as warm rolling, have been proposed. However, when textures are not sufficiently controlled, the degree to which grains are accorded with the Goss orientation ((110)[001] orientation) after secondary recrystallization tend to be lower compared to when utilizing techniques using inhibitors, resulting in the lower magnetic flux density.

CITATION LIST

Patent Literature

PTL 1: U.S. Pat. No. 1,965,559A
PTL 2: JPS4015644B
PTL 3: JPS5113469B
PTL 4: JP2782086B
PTL 5: JP2000129356A

Non-Patent Literature

NPL 1: "Sai Ramudu Meka et al.: Philos Mag vol. 92, No. 11, 11 Apr. 2012, 1435-1455"

As mentioned above, with production methods for grain-oriented electrical steel sheets using an inhibitor-less method so far proposed, it was not always easy to stably obtain good magnetic properties.

By using components with Al content reduced to less than 100 ppm, equivalent to inhibitor-less components, avoiding high-temperature slab heating, and performing nitridation to precipitate silicon nitride ($Si_3N_4$) rather than AlN, and by inhibiting normal grain growth by using the silicon nitride, the present invention enables significantly reducing variation of magnetic properties to industrially stably produce grain-oriented electrical steel sheets with good magnetic properties.

SUMMARY

In order to obtain a grain-oriented electrical steel sheet with reduced variation in magnetic properties while suppressing the slab heating temperature, the inventors of the present invention used an inhibitor-less method to prepare a primary recrystallized texture, precipitated silicon nitride therein by performing nitridation during an intermediate process step, and carried out investigation on using the silicon nitride as an inhibitor.

The inventors inferred that, if it is possible to precipitate silicon, which is normally contained in an amount of several % in a grain-oriented electrical steel sheet, as silicon nitride so as to be used as an inhibitor, a grain growth inhibiting effect would work equally well regardless of the amount of other nitride-forming elements (Al, Ti, Cr, V, etc.) by controlling the degree of nitridation at the time of nitriding treatment.

On the other hand, unlike (Al,Si)N in which Si is dissolved in AlN, pure silicon nitride has poor matching with the crystal lattice of steel and has a complicated crystal structure with covalent bonds. Accordingly, it is known that to finely precipitate pure silicon nitride in grains is extremely difficult. For this reason, it follows that it would be difficult to finely precipitate pure silicon nitride in grains after performing nitridation as in conventional methods.

However, the inventors inferred that, by taking advantage of this characteristic, it would be possible to selectively precipitate silicon nitride at grain boundaries. Further, the inventors believed that, if it is possible to selectively precipitate silicon nitride at grain boundaries, a sufficient grain growth inhibiting effect would be obtained even in the presence of coarse precipitates.

Based on the above ideas, the inventors conducted intense investigations starting from chemical compositions of the material, and narrowing down to the nitrogen increase during nitriding treatment, heat treatment conditions for forming silicon nitride by diffusing nitrogen along the grain boundary, and the like. As a result, the inventors discovered new uses of silicon nitride, and completed the present invention.

Specifically, the primary features of the present invention are as follows.

1. A production method for a grain-oriented electrical steel sheet, the method comprising: subjecting a steel slab to hot rolling, without re-heating or after re-heating, to obtain a hot rolled sheet, the steel slab having a composition consisting of, by mass % or mass ppm, C: 0.08% or less, Si: 2.0% to 4.5%, Mn: 0.5% or less, S: less than 50 ppm, Se: less than 50 ppm, O: less than 50 ppm, sol.Al: less than 100 ppm, N controlled within a range satisfying the relation of sol.Al/(26.98/14.00) ppm≤N≤80 ppm, and the balance being Fe and incidental impurities; then subjecting the hot rolled sheet to annealing and rolling to obtain a cold rolled sheet of final sheet thickness; then subjecting the cold rolled sheet to nitriding treatment with a nitrogen increase of 50 ppm or more and 1000 ppm or less, during or after primary recrystallization annealing; then applying an annealing separator on the cold rolled sheet; and setting the staying time in a temperature range of 300° C. to 800° C. in the heating stage of secondary recrystallization annealing to 5 hours or more to 150 hours or less.

2. A production method for a grain-oriented electrical steel sheet, the method comprising: subjecting a steel slab to hot rolling, without re-heating or after re-heating, to obtain a hot rolled sheet, the steel slab having a composition sonsisting of, by mass % or mass ppm, C: 0.08% or less, Si: 2.0% to 4.5%, Mn: 0.5% or less, S: less than 50 ppm, Se: less than 50 ppm, O: less than 50 ppm, sol.Al: less than 100 ppm, N controlled within a range satisfying the relation of sol.Al/(26.98/14.00) ppm≤N≤80 ppm, and the balance being Fe and incidental impurities; then subjecting the hot rolled sheet to annealing and rolling to obtain a cold rolled sheet of final sheet thickness; then subjecting the cold rolled sheet to nitriding treatment with a nitrogen increase of 50 ppm or more and 1000 ppm or less, during or after primary recrystallization annealing; then applying an annealing separator on the cold rolled sheet; then allowing N to diffuse into steel substrate, after the primary recrystallization annealing and before the start of secondary recrystallization, so as to selectively precipitate silicon nitride with a precipitate size of 100 nm or more at a grain boundary, for use as pinning force for normal grain growth.

3. The production method for a grain-oriented electrical steel sheet according to aspect 1 or 2, wherein the steel slab further contains by mass %, one or more of Ni: 0.005% to 1.50%, Sn: 0.01% to 0.50%, Sb: 0.005% to 0.50%, Cu: 0.01% to 0.50%, Cr: 0.01% 1.50%, P: 0.0050% to 0.50%, Mo: 0.01% to 0.50% and Nb: 0.0005% to 0.0100%.

4. A primary recrystallized steel sheet for production of a grain-oriented electrical steel sheet, wherein the composition thereof satisfies a composition range of, by mass % or mass ppm, C: 0.08% or less, Si: 2.0% to 4.5% and Mn: 0.5% or less, with S, Se and O: each less than 50 ppm, sol.Al: less than 100 ppm, N: 50 ppm or more and 1080 ppm or less, and the balance being Fe and incidental impurities.

5. The primary recrystallized steel sheet for production of a grain-oriented electrical steel sheet according to aspect 4, wherein the primary recrystallized steel sheet further contains by mass %, one or more of Ni: 0.005% to 1.50%, Sn: 0.01% to 0.50%, Sb: 0.005% to 0.50%, Cu: 0.01% to 0.50%, Cr: 0.01% to 1.50%, P: 0.0050% to 0.50%, Mo: 0.01% to 0.50% and Nb: 0.0005% to 0.0100%.

According to the present invention, it is possible to industrially stably produce grain-oriented electrical steel sheets having good magnetic properties with significantly reduced variation, without the need of high-temperature slab heating.

Further, in the present invention, pure silicon nitride which is not precipitated compositely with Al is used, and therefore when performing purification, it is possible to achieve purification of steel simply by purifying only nitrogen, which diffuses relatively quickly.

Further, when using Al or Ti as precipitates as in conventional methods, control in ppm order was necessary from the perspective of achieving desired purification and guaranteeing an inhibitor effect. However, when using Si as precipitates as in the present invention, such control is completely unnecessary during steelmaking.

BRIEF DESCRIPTION OF THE DRAWINGS

The present invention will be further described below with reference to the accompanying drawings, wherein.

DETAILED DESCRIPTION

Figure 1C:
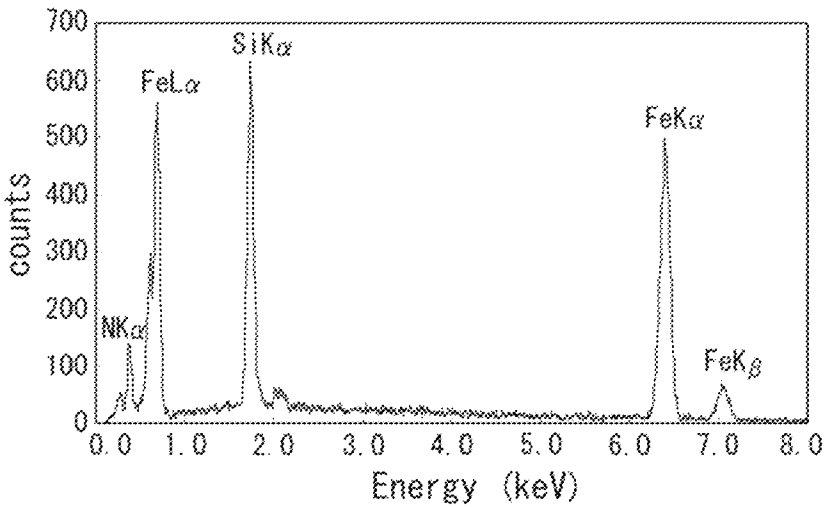
FIG. 1 shows electron microscope photographs of a microstructure subjected to decarburization annealing, followed by nitriding treatment with the nitrogen increase of 100 ppm ((a) of FIG. 1) and 500 ppm ((b) of FIG. 1), subsequently heated to 800° C. at a predetermined heating rate, and then immediately subjected to water-cooling, as well as a graph ((c) of FIG. 1) showing the identification results of precipitates in the above microstructure obtained by EDX (energy-dispersive X-ray spectrometry)

Details of the present invention are described below.

First, reasons for limiting the chemical compositions of the steel slab to the aforementioned range in the present invention will be explained. Here, unless otherwise specified, indications of "%" and "ppm" regarding components shall each stand for "mass %" and "mass ppm".

C: 0.08% or less

C is a useful element in terms of improving primary recrystallized textures. However, if the content thereof exceeds 0.08%, primary recrystallized textures deteriorate. Therefore, C content is limited to 0.08% or less. From the viewpoint of magnetic properties, the preferable C content is in the range of 0.01% to 0.06%. If the required level of magnetic properties is not very high, C content may be set to 0.01% or less for the purpose of omitting or simplifying decarburization during primary recrystallization annealing.

Si: 2.0% to 4.5%

Si is a useful element which improves iron loss properties by increasing electrical resistance. However, if the content thereof exceeds 4.5%, it causes significant deterioration of cold rolling manufacturability, and therefore Si content is limited to 4.5% or less. On the other hand, for enabling Si to function as a nitride-forming element, Si content needs to be 2.0% or more. Further, from the viewpoint of iron loss properties, the preferable Si content is in the range of 2.0% to 4.5%.

Mn: 0.5% or less

Since Mn provides an effect of improving hot workability during manufacture, it is preferably contained in the amount of 0.01% or more. However, if the content thereof exceeds 0.5%, primary recrystallized textures worsen and magnetic properties deteriorate. Therefore, Mn content is limited to 0.5% or less.

S, Se and O: less than 50 ppm (individually)

If the content of each of S, Se and O is 50 ppm or more, it becomes difficult to develop secondary recrystallization. This is because primary recrystallized microstructures are made non-uniform by coarse oxides or MnS and MnSe coarsened by slab heating. Therefore, S, Se and O are all suppressed to less than 50 ppm. The contents of these elements may also be 0 ppm.

sol.Al: less than 100 ppm

Al forms a dense oxide film on a surface of the steel sheet, and could make it difficult to control the degree of nitridation at the time of nitriding treatment or obstruct decarburization. Therefore, Al content is suppressed to less than 100 ppm in terms of sol.Al. The content thereof may also be 0 ppm.

sol.Al/(26.98/14.00) ppm≤N≤80 ppm

The present invention has a feature that silicon nitride is precipitated after performing nitridation. Therefore, it is important that N is contained beforehand in steel in an amount equal to or more than the N content required to precipitate as AlN with respect to the amount of Al contained in steel. In particular, since Al and N are bonded at a ratio of 1:1, by containing N in an amount satisfying [sol.Al]/(atomic weight of Al (26.98)/atomic weight of N (14.00)) or more, it is possible to completely precipitate a minute amount of Al contained in steel before nitriding treatment. On the other hand, since N could become the cause of defects such as blisters at the time of slab heating, N content needs to be suppressed to 80 ppm or less. The content thereof is preferably 60 ppm or less.

The basic components are as described above. In the present invention, the following elements may be contained according to necessity as components for improving magnetic properties in an even more industrially reliable manner.

Ni: 0.005% to 1.50%

Ni provides an effect of improving magnetic properties by enhancing the uniformity of texture of the hot rolled sheet, and, to obtain this effect, it is preferably contained in an amount of 0.005% or more. On the other hand, if the content thereof exceeds 1.50%, it becomes difficult to develop secondary recrystallization, and magnetic properties deteriorate. Therefore, Ni is preferably contained in a range of 0.005% to 1.50%.

Sn: 0.01% to 0.50%

Sn is a useful element which improves magnetic properties by suppressing nitridation and oxidization of the steel sheet during secondary recrystallization annealing and facilitating secondary recrystallization of crystal grains having good crystal orientation, and to obtain this effect, it is preferably contained in an amount of 0.01% or more. On the other hand, if it is contained in an amount exceeding 0.50%, cold rolling manufacturability deteriorates. Therefore, Sn is preferably contained in the range of 0.01% to 0.50%.

Sb: 0.005% to 0.50%

Sb is a useful element which effectively improves magnetic properties by suppressing nitridation and oxidization of the steel sheet during secondary recrystallization annealing and facilitating secondary recrystallization of crystal grains having good crystal orientation, and to obtain this effect, it is preferably contained in an amount of 0.005% or more. On the other hand, if it is contained in an amount exceeding 0.5%, cold rolling manufacturability deteriorates. Therefore, Sb is preferably contained in the range of 0.005% to 0.50%.

Cu: 0.01% to 0.50%

Cu provides an effect of effectively improving magnetic properties by suppressing oxidization of the steel sheet during secondary recrystallization annealing and facilitating secondary recrystallization of crystal grains having good crystal orientation, and to obtain this effect, it is preferably contained in an amount of 0.01% or more. On the other hand, if it is contained in an amount exceeding 0.50%, hot rolling manufacturability deteriorates. Therefore, Cu is preferably contained in the range of 0.01% to 0.50%.

Cr: 0.01% to 1.50%

Cr provides an effect of stabilizing formation of forsterite films, and, to obtain this effect, it is preferably contained in an amount of 0.01% or more. On the other hand, if the content thereof exceeds 1.50%, it becomes difficult to develop secondary recrystallization, and magnetic properties deteriorate. Therefore, Cr is preferably contained in the range of 0.01% to 1.50%.

P: 0.0050% to 0.50%

P provides an effect of stabilizing formation of forsterite films, and, to obtain this effect, it is preferably contained in an amount of 0.0050% or more. On the other hand, if the content thereof exceeds 0.50%, cold rolling manufacturability deteriorates. Therefore, P is preferably contained in a range of 0.0050% to 0.50%.

Mo: 0.01% to 0.50%, Nb: 0.0005% to 0.0100%

Mo and Nb both have an effect of suppressing generation of scabs after hot rolling by for example, suppressing cracks caused by temperature change during slab heating. These elements become less effective for suppressing scabs, however, unless Mo content is 0.01% or more and Nb content is 0.0005% or more. On the other hand, if Mo content exceeds 0.50% and Nb content exceeds 0.0100%, they cause deterioration of iron loss properties if they remain in the finished product as, for example, carbide or nitride. Therefore, it is preferable for each element to be contained in the above mentioned ranges.

Next, the production method for the present invention will be explained.

A steel slab adjusted to the above preferable chemical composition range is subjected to hot rolling without being re-heated or after being re-heated. When re-heating the slab, the re-heating temperature is preferably approximately in the range of 1000° C. to 1300° C. This is because slab heating at a temperature exceeding 1300° C. is not effective in the present invention where little inhibitor element is contained in steel in the form of a slab, and only causes an increase in costs, while slab heating at a temperature of lower than 1000° C. increases the rolling load, which makes rolling difficult.

Then, the hot rolled sheet is subjected to hot band annealing as necessary, and subsequent cold rolling once, or twice or more with intermediate annealing performed therebetween to obtain a final cold rolled sheet.

The cold rolling may be performed at room temperature. Alternatively, warm rolling where rolling is performed with the steel sheet temperature raised to a temperature higher than room temperature for example, around 250° C. is also applicable.

Then, the final cold rolled sheet is subjected to primary recrystallization annealing.

The purpose of primary recrystallization annealing is to anneal the cold rolled sheet with a rolled microstructure for primary recrystallization to adjust the grain size of the primary recrystallized grains so that they are of optimum grain size for secondary recrystallization. In order to do so, it is preferable to set the annealing temperature of primary recrystallization annealing approximately in the range of 800° C. to below 950° C. Further, by setting the annealing atmosphere during primary recrystallization annealing to an atmosphere of wet hydrogen-nitrogen or wet hydrogen-argon, primary recrystallization annealing may be combined with decarburization annealing.

Further, during or after the above primary recrystallization annealing, nitriding treatment is performed. As long as the degree of nitridation is controlled, any means of nitridation can be used and there is no particular limitation. For example, as performed in the past, gas nitriding may be performed directly in the form of a coil using $NH_3$ atmosphere gas, or continuous gas nitriding may be performed on a running strip. Further, it is also possible to utilize salt bath nitriding with higher nitriding ability than gas nitriding. Here, a preferred salt bath for salt bath nitriding is a salt bath mainly composed of cyanate.

The important point of the above nitriding treatment is the formation of a nitride layer on the surface layer. In order to suppress diffusion into steel, it is preferable to perform nitriding treatment at a temperature of 800° C. or lower, yet, by shortening the duration of the treatment (e.g. to around 30 seconds), it is possible to form a nitride layer only on the surface even if the treatment is performed at a higher temperature. Further, it is necessary for the nitrogen increase caused by nitriding to be 50 ppm or more and 1000 ppm or less. If the nitrogen increase is less than 50 ppm, a sufficient effect cannot be obtained, whereas if it exceeds 1000 ppm, an excessive amount of silicon nitride precipitates and secondary recrystallization is hardly caused. The nitrogen increase is preferably in the range of 200 ppm to less than 1000 ppm.

In "Sai Ramudu Meka et al.: Philos Mag vol. 92, No. 11, 11 Apr. 2012, 1435-1455 (NPL 1)", nitriding treatment is performed after rolling and before recrystallization to precipitate silicon nitride inside grains. However, if nitriding treatment is performed after rolling, nitrogen diffusion occurs at dislocations, and therefore it is not possible to achieve selective precipitation at grain boundaries which is intended in the present invention. Therefore, it is important that nitriding treatment is performed at a timing of at least either during or after primary recrystallization annealing following the completion of recrystallization.

After subjecting the steel sheet to the above primary recrystallization annealing and nitriding treatment, an annealing separator is applied onto a surface of the steel sheet. In order to form a forsterite film on the surface of the steel sheet after secondary recrystallization annealing, it is necessary to use an annealing separator mainly composed of magnesia (MgO). However, if there is no need to form a forsterite film, any suitable oxide with a melting point higher than the secondary recrystallization annealing temperature, such as alumina ($Al_2O_3$) or calcia (CaO), can be used as the main component of the annealing separator.

Subsequently, secondary recrystallization annealing is performed. During this secondary recrystallization annealing, it is necessary to set the staying time in the temperature range of 300° C. to 800° C. in the heating stage to 5 hours or more to 150 hours or less. During the staying time, the nitride layer in the surface layer is decomposed and N diffuses into the steel. As for the chemical composition of the present invention, Al which is capable of forming AlN does not remain, and therefore N as a grain boundary segregation element diffuses into steel using grain boundaries as diffusion paths.

Silicon nitride has poor matching with the crystal lattice of steel (i.e. the misfit ratio is high), and therefore the precipitation rate is very low. Nevertheless, since the purpose of precipitation of silicon nitride is to inhibit normal grain growth, it is necessary to have a sufficient amount of silicon nitride selectively precipitated at grain boundaries at the stage of 800° C. at which normal grain growth proceeds. Regarding this point, silicon nitride cannot precipitate inside grains, yet by setting the staying time in the temperature range of 300° C. to 800° C. to 5 hours or more, it is possible to selectively precipitate silicon nitride at grain boundaries by allowing silicon to be bound to N diffusing along the grain boundaries. Although an upper limit of the staying time is not necessarily required, performing annealing for more than 150 hours is unlikely to increase the effect. Therefore, the upper limit is set to 150 hours in the present invention. Further, as the annealing atmosphere, either of $N_2$, Ar, $H_2$ or a mixed gas thereof is applicable.

As described above, with a grain-oriented electrical steel sheet obtained by applying the above process to a slab that contains a limited amount of Al in steel, with an excessive amount of N with respect to AlN precipitation added thereto, and contains little inhibitor components such as MnS or MnSe, it is possible to selectively precipitate coarse silicon nitride (with a precipitate size of 100 nm or more), as compared to conventional inhibitors, at grain boundaries at the stage during the heating stage of secondary recrystallization annealing before secondary recrystallization starts. Although there is no particular limit on the upper limit of the precipitate size of silicon nitride, it is preferably 5 μm or less.

Figure 1A:
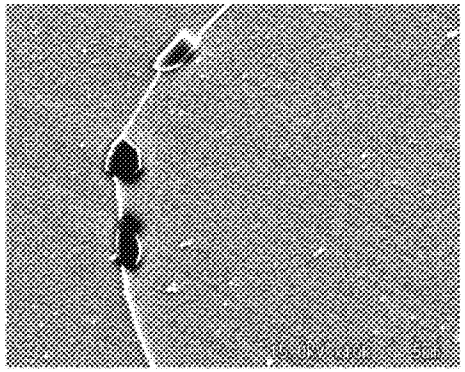
Figure 1B:
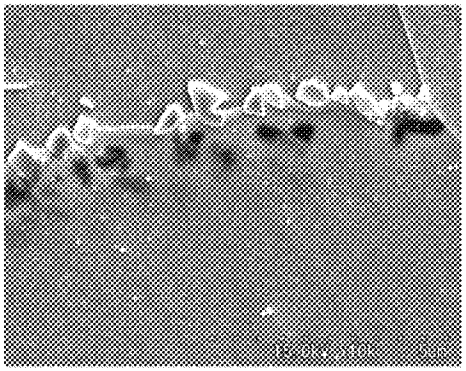

FIG. 1 shows electron microscope photographs for observation and identification of a microstructure subjected to decarburization annealing, followed by nitriding treatment with the nitrogen increase of 100 ppm ((a) of FIG. 1) and 500 ppm ((b) of FIG. 1), subsequently heated to 800° C. at a heating rate such that the staying time in the temperature range of 300° C. to 800° C. is 8 hours, and then immediately subjected to water-cooling, which were observed and identified using an electron microscope. Further, graph (c) in FIG. 1 shows the results of identification of precipitates in the aforementioned microstructure by EDX (energy-dispersive X-ray spectrometry).

It can be seen from FIG. 1 that unlike fine precipitates conventionally used (with a precipitate size of smaller than 100 nm), even the smallest one of the coarse silicon nitride precipitates at the grain boundary has a precipitate size greater than 100 nm.

Further, samples were subjected to the process steps up to primary recrystallization annealing combined with decarburization in a lab, using steel ingot A prepared by steelmaking with Si: 3.2%, sol.Al<5 ppm, and N: 10 ppm as steel components, and steel ingot B prepared by steelmaking with Si: 3.2%, sol.Al: 150 ppm, and N: 10 ppm as steel components. The samples were then subjected to gas nitriding treatment using $NH_3$—$N_2$ combined gas with a nitrogen increase of 200 ppm. Microstructures of the samples after the nitriding treatment thus obtained were observed using an electron microscope. Then, the samples after the nitriding treatment were heated to 800° C. with the same heat pattern as secondary recrystallization annealing, and then subjected to water-cooling. Microstructures of the samples thus obtained were observed under an electron microscope.

Figure 2:
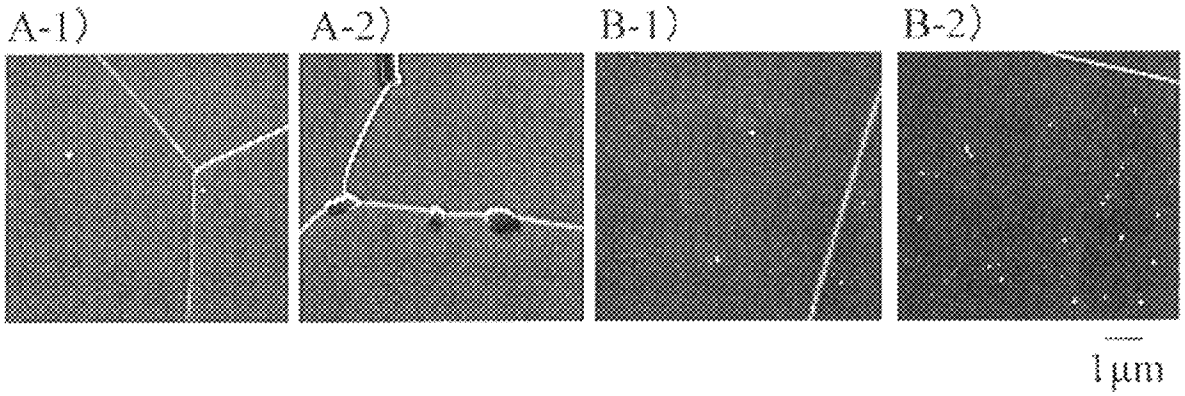
FIG. 2 shows electron microscope photographs of steel ingots A, B (A-1, B-1) after nitriding treatment and after heating (A-2, B-2).

The observation results are shown in FIG. 2. In FIG. 2, A-1 and B-1 are electron microscope photographs of steel ingots A and B after nitriding treatment, and A-2 and B-2 are electron microscope photographs of steel ingots A and B after heating.

It can be seen that for steel ingot A which does not contain Al, little precipitates are observed after nitriding treatment (A-1), while after heating and water-cooling (A-2), $Si_3N_4$ with a precipitate size of 100 nm or more precipitates at the grain boundaries. On the other hand, for steel ingot B which contains Al, although precipitates can hardly be identified after nitriding treatment (B-1) as in the case of steel ingot A, it is observed that (Al,Si)N of conventional type precipitate in the grain after heating (B-2).

The use of pure silicon nitride which is not precipitated compositely with Al which is a feature of the present invention, has significantly high stability from the viewpoint of effectively utilizing Si which exists in steel in order of several % and provides an effect of improving iron loss properties. That is, components such as Al or Ti, which have been used in conventional techniques, have high affinity with nitrogen and provide precipitates which still remain stable at high temperature. Therefore, these components tend to remain in steel finally, and the remaining components could become the cause of deteriorating magnetic properties.

However, when using silicon nitride, it is possible to achieve purification of precipitates which are harmful to magnetic properties simply by purifying only nitrogen, which diffuses relatively quickly.

Further, when using Al or Ti, control in ppm order is necessary from the viewpoint that purification is eventually required and that an inhibitor effect must surely be obtained. However, when using Si, such control is unnecessary during steelmaking, and this is also an important feature of the present invention.

In production, it is clear that utilizing the heating stage of secondary recrystallization is most effective for precipitation of silicon nitride in terms of energy efficiency, yet it is also possible to selectively precipitate silicon nitride at grain boundaries by utilizing a similar heat cycle. Therefore, in production, it is also possible to perform silicon nitride dispersing annealing before time consuming secondary recrystallization.

After the above secondary recrystallization annealing, it is possible to further apply and bake an insulating coating on the surface of the steel sheet. Such an insulating coating is not limited to a particular type, and any conventionally known insulating coating is applicable. For example, preferred methods are described in JPS5079442A and JPS4839338A where a coating liquid containing phosphate-chromate-colloidal silica is applied onto a steel sheet and then baked at a temperature of around 800° C.

It is possible to correct the shape of the steel sheet by flattening annealing, and further to combine the flattening annealing with baking treatment of the insulating coating.

EXAMPLES

Example 1

A steel slab having a composition containing C: 0.06%, Si: 3.3%, Mn: 0.08%, S: 0.001%, Se: 5 ppm or less, O: 10 ppm, Al: 0.002%, N: 0.002%, Cu: 0.05% and Sb: 0.01%, with the balance including Fe and incidental impurities, was heated at 1100° C. for 30 minutes, and then subjected to hot rolling to obtain a hot rolled sheet with a thickness of 2.2 mm. Then, the steel sheet was subjected to annealing at 1000° C. for 1 minute, and subsequent cold rolling to obtain a final sheet thickness of 0.23 mm. Then, samples of the size of 100 mm×400 mm were collected from the center part of the obtained cold rolled coil, and primary recrystallization annealing combined with decarburization was performed in a lab. For some of the samples, primary recrystallization annealing combined with decarburization and nitriding (continuous nitriding treatment: nitriding treatment utilizing a mixed gas of $NH_3$, $N_2$ and $H_2$) was performed. Then, samples which were not subjected to nitriding were subjected to nitriding treatment in conditions shown in Table 1 (batch processing: nitriding treatment with salt bath using salt mainly composed of cyanate, and nitriding treatment using a mixed gas of $NH_3$ and $N_2$) to increase the nitrogen content in steel. The nitrogen content was quantified by chemical analysis for samples with full thickness as well as samples with surface layers (on both sides) removed by grinding 3 μm off from the surfaces of the steel sheet with sand paper.

Twenty-one steel sheet samples were prepared for each condition, and an annealing separator mainly composed of MgO and containing 5% of $TiO_2$ was made into a water slurry state and then applied, dried and baked on the samples. Among them, twenty samples were subjected to final annealing in conditions shown in Table 1, and then a phosphate-based insulation tension coating was applied and baked thereon to obtain products.

For the obtained products, the magnetic flux density $B_8$ (T) at a magnetizing force of 800 A/m was evaluated. Magnetic properties of each condition were evaluated from the average value of twenty samples. The remaining one sample was heated to 800° C. with the same heat pattern as final annealing, and then removed and directly subjected to water quenching. Regarding these samples, silicon nitride in the microstructure was observed using an electron microscope and the average precipitate size of fifty silicon nitride precipitates was measured.

TABLE 1

| | Nitriding Treatment | | | Analysis Value of N after Nitriding | | Final Annealing Condition Retention Time | Silicon Nitride Average | Magnetic | |
|---|---|---|---|---|---|---|---|---|---|
| | Treatment Method | Treatment Temperature (° C.) | Treatment Time (s) | at Overall Thickness (mass ppm) | after Removing Surface Layer (mass ppm) | in Temp. Range of 300° C. to 800° C. (h) | Grain Size (nm) | Properties $B_8$ (T) | Remarks |
| Condition 1 | None | — | — | 20 | 20 | 20 | — | 1.882 | Comparative Example |
| Condition 2 | Salt Bath by Batch | 500 | 100 | 200 | 40 | 20 | 350 | 1.913 | Inventive Example |

TABLE 1-continued

| | Nitriding Treatment | | | Analysis Value of N after Nitriding | | Final Annealing Condition Retention Time | Silicon Nitride Average | Magnetic | |
|---|---|---|---|---|---|---|---|---|---|
| | Treatment Method | Treatment Temperature (° C.) | Treatment Time (s) | at Overall Thickness (mass ppm) | after Removing Surface Layer (mass ppm) | in Temp. Range of 300° C. to 800° C. (h) | Grain Size (nm) | Properties $B_8$ (T) | Remarks |
| Condition 3 | Salt Bath by Batch | 600 | 240 | 2600 | 430 | 20 | 600 | 1.718 | Comparative Example |
| Condition 4 | Salt Bath by Batch | 480 | 30 | 40 | 20 | 20 | 200 | 1.862 | Comparative Example |
| Condition 5 | Salt Bath by Batch | 480 | 120 | 150 | 20 | 20 | 300 | 1.903 | Inventive Example |
| Condition 6 | Salt Bath by Batch | 550 | 30 | 100 | 25 | 5 | 100 | 1.901 | Inventive Example |
| Condition 7 | Salt Bath by Batch | 500 | 100 | 200 | 40 | 4 | 80 | 1.885 | Comparative Example |
| Condition 8 | Batch Gas | 450 | 300 | 500 | 30 | 40 | 400 | 1.913 | Inventive Example |
| Condition 9 | Batch Gas | 850 | 20 | 350 | 25 | 40 | 420 | 1.916 | Inventive Example |
| Condition 10 | Batch Gas | 850 | 200 | 1200 | 230 | 40 | 700 | 1.752 | Comparative Example |
| Condition 11 | Continuous Gas | 700 | 20 | 250 | 25 | 60 | 650 | 1.916 | Inventive Example |
| Condition 12 | Continuous Gas | 700 | 20 | 250 | 25 | 4 | 70 | 1.878 | Comparative Example |

As can be seen in Table 1, it is clear that magnetic properties are improved in the inventive examples compared to those produced in the inhibitor-less manufacturing process.

Example 2

A steel slab containing components shown in Table 2 (the contents of S, Se, and O each being less than 50 ppm) was heated at 1200° C. for 20 minutes, subjected to hot rolling to obtain a hot rolled sheet with a thickness of 2.0 mm. Then, the hot rolled sheet was subjected to annealing at 1000° C. for 1 minute, then cold rolling to have a sheet thickness of 1.5 mm, then intermediate annealing at 1100° C. for 2 minutes, then cold rolling described below to obtain a final sheet thickness of 0.27 mm, and then decarburization annealing where the cold rolled sheet was retained at an annealing temperature of 820° C. for 2 minutes, in an atmosphere of $P(H_2O)/P(H_2)=0.3$. Then, some of the coils were subjected to nitriding treatment (in $NH_3$ atmosphere) by batch processing to increase the N content in steel by 70 ppm or 550 ppm. Then, annealing separators, each mainly composed of MgO with 10% of $TiO_2$ added thereto, were mixed with water, made into slurry state and applied thereon, respectively, which in turn were wound into coils and then subjected to final annealing at a heating rate where the staying time in the temperature range of 300° C. to 800° C. was 30 hours. Then, a phosphate-based insulation tension coating was applied and baked thereon, and flattening annealing was performed for the purpose of flattening the resulting steel strips to obtain products.

Epstein test pieces were collected from the product coils thus obtained and the magnetic flux density $B_8$ thereof was measured. The measurement results are shown in Table 2.

TABLE 2

| | Chemical Composition | | | | | | Nitrogen Increase | Magnetic Properties | |
|---|---|---|---|---|---|---|---|---|---|
| No. | Si (mass %) | C (mass ppm) | Mn (mass %) | sol. Al (mass ppm) | N (mass ppm) | Others (mass %) | ΔN (mass ppm) | $B_8$ (T) | Remarks |
| 1 | 3.35 | 400 | 0.03 | 180 | 70 | — | None | 1.802 | Comparative Example |
| 2 | 3.35 | 400 | 0.03 | 180 | 70 | — | 550 | 1.836 | Comparative Example |
| 3 | 3.35 | 400 | 0.03 | 80 | 30 | — | None | 1.872 | Comparative Example |
| 4 | 3.35 | 400 | 0.03 | 80 | 30 | — | 70 | 1.875 | Comparative Example |
| 5 | 3.35 | 400 | 0.03 | 80 | 50 | — | None | 1.875 | Comparative Example |
| 6 | 3.35 | 400 | 0.03 | 80 | 50 | — | 550 | 1.907 | Inventive Example |
| 7 | 1.85 | 400 | 0.03 | 80 | 50 | — | None | 1.865 | Comparative Example |
| 8 | 1.85 | 400 | 0.03 | 80 | 50 | — | 550 | 1.873 | Comparative Example |
| 9 | 2.5 | 200 | 0.1 | 50 | 20 | — | 70 | 1.888 | Comparative Example |

TABLE 2-continued

| | Chemical Composition | | | | | | Nitrogen Increase | Magnetic Properties | |
|---|---|---|---|---|---|---|---|---|---|
| No. | Si (mass %) | C (mass ppm) | Mn (mass %) | sol. Al (mass ppm) | N (mass ppm) | Others (mass %) | ΔN (mass ppm) | $B_8$ (T) | Remarks |
| 10 | 2.5 | 200 | 0.1 | 50 | 40 | — | 70 | 1.900 | Inventive Example |
| 11 | 3.35 | 600 | 0.08 | 60 | 40 | — | None | 1.878 | Comparative Example |
| 12 | 3.35 | 600 | 0.08 | 60 | 40 | — | 550 | 1.918 | Inventive Example |
| 13 | 3.35 | 600 | 0.08 | 60 | 40 | Ni: 0.01, Sb: 0.02 | 550 | 1.925 | Inventive Example |
| 14 | 3.35 | 600 | 0.08 | 60 | 40 | Sn: 0.03 | 550 | 1.924 | Inventive Example |
| 15 | 3.35 | 600 | 0.08 | 60 | 40 | Cr: 0.03, Mo: 0.05 | 550 | 1.922 | Inventive Example |
| 16 | 3.35 | 600 | 0.08 | 60 | 40 | Cu: 0.05 | 550 | 1.920 | Inventive Example |
| 17 | 3.35 | 600 | 0.08 | 60 | 40 | P: 0.01, Nb: 0.001 | 550 | 1.923 | Inventive Example |

It can be seen from Table 2 that all of the inventive examples obtained in accordance with the present invention exhibited high magnetic flux density.

The invention claimed is:

1. A production method for a grain-oriented electrical steel sheet, the method comprising:

subjecting a steel slab to hot rolling, without re-heating or after re-heating, to obtain a hot rolled sheet, the steel slab having a composition comprising, by mass % or mass ppm:

C: 0.08% or less,

Si: 2.0% to 4.5%,

Mn: 0.5% or less,

S: less than 50 ppm,

Se: less than 50 ppm,

O: less than 50 ppm, sol.Al: less than 100 ppm,

N controlled within a range where the relationship sol.Al/(26.98/14.00) ppm≤N≤80 ppm is satisfied, and the balance being Fe and incidental impurities;

then subjecting the hot rolled sheet to annealing and rolling to obtain a cold rolled sheet of final sheet thickness;

then subjecting the cold rolled sheet to nitriding treatment with a nitrogen increase in a range of 50 ppm or more and 1000 ppm or less, during or after primary recrystallization annealing;

then applying an annealing separator on the cold rolled sheet; and setting the staying time in a temperature range of 300° C. to 800° C. in the heating stage of secondary recrystallization annealing to 5 hours or more to 150 hours or less to diffuse N into a steel substrate so as to selectively precipitate silicon nitride at a grain boundary with a precipitate size of 100 nm or more in order to provide a pinning force for normal grain growth, wherein the nitriding treatment is performed at a temperature of 800° C. or lower, and 89% or more of the nitrogen introduced into the cold rolled steel sheet localizes in a surface region of 3 μm thick in the nitriding treatment.

2. The production method for a grain-oriented electrical steel sheet according to claim 1, wherein the steel slab further comprises, by mass %, one or more of Ni: 0.005% to 1.50%, Sn: 0.01% to 0.50%, Sb: 0.005% to 0.50%, Cu: 0.01% to 0.50%, Cr: 0.01% 1.50%, P: 0.0050% to 0.50%, Mo: 0.01% to 0.50% and Nb: 0.0005% to 0.0100%.

* * * * *